US008331818B2

(12) United States Patent
Berg et al.

(10) Patent No.: US 8,331,818 B2
(45) Date of Patent: Dec. 11, 2012

(54) OPTIMIZED FUSING FOR HIGH SPEED ELECTROPHOTOGRAPHY SYSTEM

(75) Inventors: Richard H. Berg, Parma, NY (US); Muhammed Aslam, Rochester, NY (US); James D. Shifley, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 488 days.

(21) Appl. No.: 12/507,823

(22) Filed: Jul. 23, 2009

(65) Prior Publication Data

US 2011/0020024 A1 Jan. 27, 2011

(51) Int. Cl.
*G03G 15/20* (2006.01)

(52) U.S. Cl. ..... 399/67; 399/323; 399/329

(58) Field of Classification Search ..... 399/329, 399/323, 67, 68
See application file for complete search history.

(56) References Cited

U.S. PATENT DOCUMENTS

| | | | | |
|---|---|---|---|---|
| 3,983,287 | A | 9/1976 | Goossen et al. | |
| 4,791,275 | A | 12/1988 | Lee et al. | |
| 4,984,027 | A | 1/1991 | Derimiggio et al. | |
| 5,450,183 | A | 9/1995 | O'Leary | |
| 6,016,409 | A | 1/2000 | Beard et al. | |
| 6,224,978 | B1 | 5/2001 | Chen et al. | |
| 6,643,490 | B2 * | 11/2003 | Regimbal | 399/329 |
| 7,684,746 | B2 * | 3/2010 | Asakura et al. | 399/330 |
| 2005/0002704 | A1 * | 1/2005 | Nakamura et al. | 399/341 |
| 2005/0214014 | A1 * | 9/2005 | Baruch et al. | 399/69 |
| 2009/0154943 | A1 | 6/2009 | Ciaschi et al. | |
| 2010/0178085 | A1 * | 7/2010 | Keenan et al. | 399/323 |

OTHER PUBLICATIONS

Allan D. Kraus and Avram Bar-Cohen, Thermal Analysis and Control of Electronic Equipment, 1983, pp. 204-205.

E.D. Lightbourn, Thermal Contact Resistance of Metal Roller to Plastic Web Interfaces, 1999, Chapter 3, Static Test Results, pp. 49-56.

Andrew Ciaschi, Externally Heated Fuser Device With Extended NIP Width, U.S. Appl. No. 12/323,495, filed Nov. 26, 2008.

* cited by examiner

*Primary Examiner* — David Gray
*Assistant Examiner* — Gregory H Curran
(74) *Attorney, Agent, or Firm* — Donna P. Suchy

(57) ABSTRACT

A fuser and receiver release system and method are provided for improving the release of receivers in high speed of printing systems. This system controls the release of a receiver in conjunction with a fuser in a printing system, and specifically the efficiency and accuracy of the release system. One embodiment of this method includes a belt fuser that allows the separating of the heat transfer and release functions of the fuser such that fuser roller could be made of hard metal core that can be heated to high temperatures without the fear of delaminating elastomeric coatings which are common in roller fusing.

20 Claims, 6 Drawing Sheets

TEMPERATURE DESIGNATIONS
FOR SIMULATED PROBE.

LINEAR TEMPERATURE PROFILE FOR
THIS REAL INTERFACE CONDITION.

OPTIMIZED FUSING FOR HIGH SPEED ELECTROPHOTOGRAPHY SYSTEM

FIELD OF THE INVENTION

The invention relates generally to the field of printing, and more particularly to processes and apparatus for maintaining quality in digital reproduction systems by controlling the fuser used in the electrostatographic printing process.

BACKGROUND OF THE INVENTION

In electrostatographic imaging and recording processes such as electrophotographic reproduction, an electrostatic latent image is formed on a primary image-forming member such as a photoconductive surface and is developed with a thermoplastic toner powder to form a toner image. The toner image is thereafter transferred to a receiver, e.g., a sheet of paper or plastic, and the toner image is subsequently fused to the receiver in a fusing station using heat or pressure, or both heat and pressure. The fuser station can include a roller, belt, or any surface having a suitable shape for fixing thermoplastic toner powder to the receiver.

The fusing step in a roller fuser commonly consists of passing the toned receiver between a pair of engaged rollers that produce an area of pressure contact known as a fusing nip. In order to form the fusing nip, at least one of the rollers typically has a compliant or conformable layer on its surface. Heat is transferred from at least one of the rollers to the toner in the fusing nip, causing the toner to partially melt and attach to the receiver. In the case where the fuser member is a heated roller, a resilient compliant layer having a smooth surface is typically used which is bonded either directly or indirectly to the core of the roller. Where the fuser member is in the form of a belt, e.g., a flexible endless belt that passes around the heated roller, it typically has a smooth, hardened outer surface.

Most roller fusers, known as simplex fusers, attach toner to only one side of the receiver at a time. In this type of fuser, the roller that contacts the unfused toner is commonly known as the fuser roller and is usually the heated roller. The roller that contacts the other side of the receiver is known as the pressure roller and is usually unheated. Either or both rollers can have a compliant layer on or near the surface. In most fusing stations having a fuser roller and an engaged pressure roller, it is common for only one of the two rollers to be driven rotatably by an external source. The other roller is then driven rotatably by frictional contact.

In a duplex fusing station, which is less common, two toner images are simultaneously attached, one to each side of a receiver passing through a fusing nip. In such a duplex fusing station there is no real distinction between fuser roller and pressure roller, both rollers performing similar functions, i.e., providing heat and pressure.

Two basic types of simplex heated roller fusers have evolved. One uses a conformable or compliant pressure roller to form the fusing nip against a hard fuser roller, such as in a DocuTech 135 machine made by the Xerox Corporation. The other uses a compliant fuser roller to form the nip against a hard or relatively non-conformable pressure roller, such as in a Digimaster 9110 machine made by Eastman Kodak Company. A fuser roller designated herein as compliant typically includes a conformable layer having a thickness greater than about 2 mm and in some cases exceeding 25 mm. A fuser roller designated herein as hard includes a rigid cylinder, which may have a relatively thin polymeric or conformable elastomeric coating, typically less than about 1.25 mm thick.

A compliant fuser roller used in conjunction with a hard pressure roller tends to provide easier release of a receiver from the heated fuser roller, because the distorted shape of the compliant surface in the nip tends to bend the receiver towards the relatively non-conformable pressure roller and away from the much more conformable fuser roller.

A conventional toner fuser roller includes a cylindrical core member, often metallic such as aluminum, coated with one or more synthetic layers, which typically include polymeric materials made from elastomers.

One common type of fuser roller is internally heated, i.e., a source of heat for fusing is provided within the roller for fusing. Such a fuser roller normally has a hollow core, inside of which is located a heating source, usually a lamp. Surrounding the core is an elastomeric layer through which heat is conducted from the core to the surface, and the elastomeric layer typically contains fillers for enhanced thermal conductivity. A different kind of fuser roller that is internally heated near its surface is disclosed by Lee et al. in U.S. Pat. No. 4,791,275, which describes a fuser roller including two polyimide Kapton® sheets (sold by DuPont® and Nemours) having a flexible ohmic heating element disposed between the sheets. The polyimide sheets surround a conformable polyimide foam layer attached to a core member. According to J. H. DuBois and F. W. John, Eds., in Plastics, 5th Edition, Van Nostrand and Rheinhold, 1974, polyimide at room temperature is fairly stiff with a Young's modulus of about 3.5 GPa-5.5 GPa (1 GPa=1 GigaPascal=10.sup.9 Newton/m.sup.2), but the Young's modulus of the polyimide sheets can be expected to be considerably lower at the stated high operational fusing temperature of the roller of at least 450 degrees F.

An externally heated fuser roller is used, for example, in an Image Source 120 copier, and is heated by surface contact between the fuser roller and one or more external heating rollers. Externally heated fuser rollers are also disclosed by O'Leary, U.S. Pat. No. 5,450,183, and by Derimiggio et al., U.S. Pat. No. 4,984,027.

A compliant fuser roller may include a conformable layer of any useful material, such as for example a substantially incompressible elastomer, i.e., having a Poisson's ratio approaching 0.5. A substantially incompressible conformable layer including a poly (dimethyl siloxane) elastomer has been disclosed by Chen et al., in the commonly assigned U.S. Pat. No. 6,224,978, which is hereby incorporated by reference. Alternatively, the conformable layer may include a relatively compressible foam having a value of Poisson's ratio much lower than 0.5. A conformable polyimide foam layer is disclosed by Lee in U.S. Pat. No. 4,791,275 and a lithographic printing blanket are disclosed by Goosen et al. in U.S. Pat. No. 3,983,287, including a conformable layer containing a vast number of frangible rigid-walled tiny bubbles that are mechanically ruptured to produce a closed cell foam having a smooth surface.

Receivers remove the majority of heat during fusing. Since receivers may have a narrower length measured parallel to the fuser roller axis than the fuser roller length, heat may be removed differentially, causing areas of higher temperature or lower temperature along the fuser roller surface parallel to the roller axis. Higher or lower temperatures can cause excessive toner offset (i.e., toner powder transfer to the fuser roller) in roller fusers. However, if differential heat can be transferred axially along the fuser roller by layers within the fuser roller having high thermal conductivity, the effect of differential heating can be reduced.

Improved heat transfer from the core to the surface of an internally heated roller fuser will reduce the temperature of the core as well as that of mounting hardware and bearings that are attached to the core. Similarly, improved heat transfer to the surface of an externally heated fuser roller from external heating rollers will reduce the temperature of the external heating rollers as well as the mounting hardware and bearings attached to the external heating rollers.

In the fusing of the toner image to the receiver, the area of contact of a conformable fuser roller with the toner-bearing surface of a receiver sheet as it passes through the fusing nip is determined by the amount pressure exerted by the pressure roller and by the characteristics of the resilient conformable layer. The extent of the contact area helps establish the length of time that any given portion of the toner image will be in contact with, and heated by, the fuser roller.

A fuser module is disclosed by M. E. Beard et al., in U.S. Pat. No. 6,016,409, which includes an electronically-readable memory permanently associated with the module, whereby the control system of the printing apparatus reads out codes from the electronically readable memory at install to obtain parameters for operating the module, such as maximum web use, voltage and temperature requirements, and thermistor calibration parameters.

In a roller fusing system, the fusing parameters, namely the temperature, nip-width, and speed of the fusing member, are fixed and controlled within certain specifications for a given range of receivers. Generally the system changes the temperature or/and speed according to the receiver weights or types. The changing of temperature in an internally heated fuser roller takes time to stabilize. If the receivers are presented at a too-rapid rate, the fuser roller may not have returned to its working temperature when the next receiver arrives. Consequently, the receivers must be stopped or slowed until the temperature of the fuser roller has come within acceptable range and such stopping or slowing results in degradation of receiver throughput rate. The same is true for speed changes. Regardless of whether the speed of presentation or the fuser roller temperature itself is being adjusted by the system, the temperature stabilization time required by a fusing member can constrain the speed of presentation of receivers.

The fixing quality of toned images of an electrophotographic printer depends on the temperature, nip-width, process speed, and thermal properties of the fusing member, toner chemistry, toner coverage, and receiver type. To simplify the engineering and control of a roller fusing system, as many as possible of the above parameters are considered and then fixed during the system's design. The fusing parameters such as temperature, nip-width, process speed, and thermal properties of the fusing member are optimized for the most critical case.

Complicating the system's design is the fact that the toner coverage and the receiver type (weight, coated/uncoated) can vary from image to image in a digital printer. Therefore, some of the above listed parameters need to be adjusted according to the image contents and the receiver types to assure adequate image fixing. Typically, the fuser temperature is adjusted and kept constant for a dedicated run with a particular receiver. The temperatures are adjusted higher from the nominal, for heavier receivers and lower for lighter receivers. For some heavy receivers, the speed must also be reduced.

The change of fuser temperature and/or reduction of speed results in reduced productivity. Furthermore, if different receiver types are required in a single document, extra time is needed to collate images on different receivers into the document.

The receiver released is often a problem in high speed printers. In the prior art one mechanism used to facilitate the separation of a fused image from a heated fusing surface, such as that provided by heated rollers, was to cover the rollers with some sort of elastomeric layer and topped with a low surface energy polymeric coating. In other instances a mechanical or high pressure air skives was used to assist the release of the media from the fusing surface. These methods have disadvantages for example the contact skives can leave streaking artifacts on the image and air skives require a large supply of forced air. The main drawback of these methods is that a roller fuser configuration that has an elastomer layer on the fuser roller forms a nip that effectively acts as a thermal barrier.

In order to facilitate higher heat transfer required at increasing print engine speeds there is a need for the elastomer covering on the fuser roller to be minimized as compared to the backup roller. This creates a situation where the media separation from the fuser roller surface becomes more difficult. In other words the requirements for the heat transfer and the nip shape for a better release of media from an internally heated fuser roller compete against each other. Unfortunately often improving the heat transfer deteriorates the media release from the fusing surface of internally heated roller fusers.

On the contrary, in externally heated fusers the media release issue has been solved by providing a softer (or thicker) layer of elastomer on the fuser roller relative to the backup roller. Since the heat for externally heated rollers is provided by external means, thicker fuser roller coatings are used to provide a larger nip for the external heating roller thus increasing the contact time and the heat flow. Most commonly with heated metal rollers, high-speed printing creates a difficult problem because the high temperature and high stress employed by the heating rollers to the top soft release layer of the fuser roller may reduce its useful life. Also some roller fusers are a combination of both internal and external heating types described above.

There is a need to solve various problems that will result in improved media separation from the fusing surface (belt) without requiring forced air to release the media. One of these problems is supplying enough heat to fuse an image in the higher speed printers. The following invention solves this problem in a wide variety of situations.

SUMMARY OF THE INVENTION

In accordance with an object of the invention, both a system and a method are provided for improving the controlled release of a receiver in conjunction with a fuser in a printing system, and specifically the efficiency and accuracy of the release system. One embodiment of this method includes a belt fuser that allows the separating of the heat transfer and release functions of the fuser such that fuser roller could be made of hard metal core that can be heated to high temperatures without the fear of delaminating elastomeric coatings which are common in roller fusing. The release is achieved by bending the fuser belt around a smaller release roller after the fuser nip between the rollers. Media stiffness will make the media to separate from the belt at a sharp bend at roller. Furthermore additional heat can be provided by an external heat source such as heated roller.

While the specification concludes with claims particularly pointing out and distinctly claiming the subject matter of the present invention, it is believed the invention will be better understood from the following detailed description when taken in conjunction with the accompanying drawings.

BRIEF DESCRIPTION OF THE DRAWINGS

For a better understanding of the characteristics of this invention the invention will now be described in detail with reference to the accompanying drawings, wherein.

DETAILED DESCRIPTION OF THE INVENTION

The present description will be directed in particular to elements forming part of, or cooperating more directly with, apparatus and methods in accordance with the present invention. It is to be understood that elements not specifically shown or described may take various forms well known to those skilled in the art.

Various aspects of the invention are presented in FIGS. 1-4 which are not drawn to scale and in which like components are numbered alike. According to one aspect of the invention, the thermal response of the fuser with sheets being fed through the fuser is simulated in the fuser prior to feeding sheets through the fuser. The thermal response may be simulated in a manner that minimizes thermal droop, or it may be simulated in a manner that maintains a nip force, or it may be simulated in a manner that accomplishes both. According to a further aspect of the invention, the thermal response of the fuser with sheets being fed through the fuser is controlled to maintain a desired tentering force. The desired tentering force may be varied based on sheet width, or sheet heat absorbing capacity, or sheet stiffness, or combinations of these (all combinations thereof being included within the purview of the invention).

Figure 1:
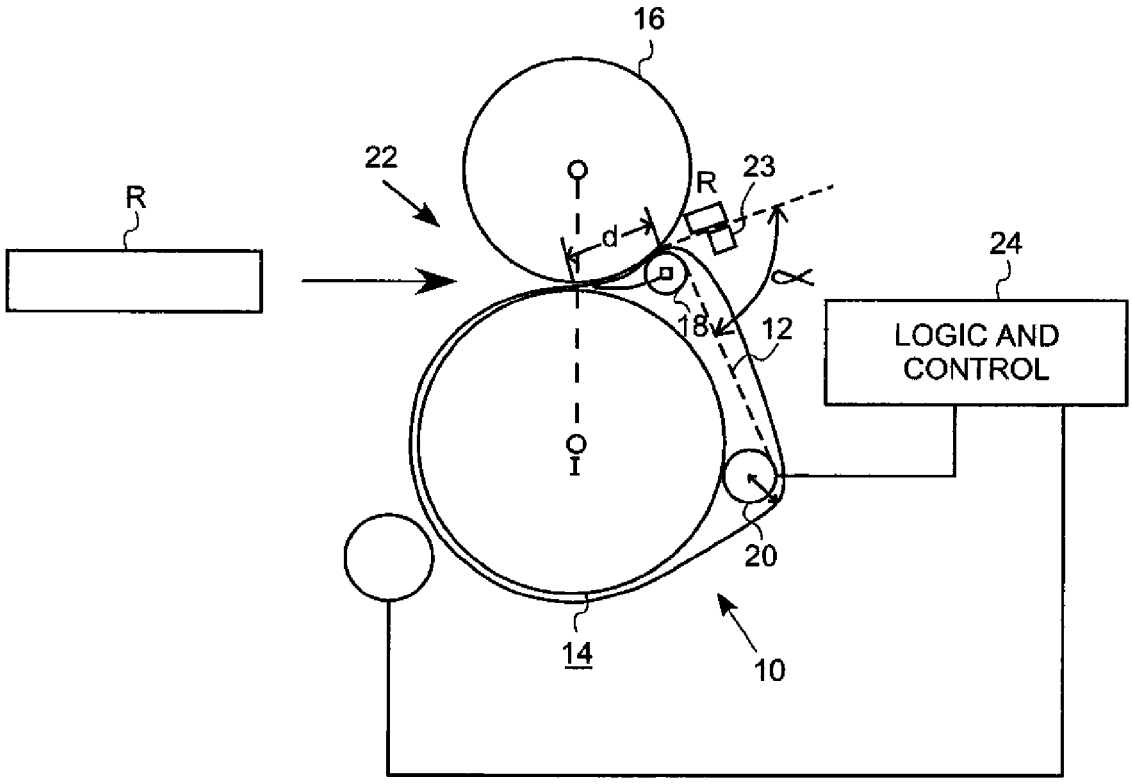
FIG. 1 is a schematic illustration of a printer system according to the present invention for use in conjunction with an image control system and method.

The fuser release system 10 shown in FIG. 1 employs a movable fusing element 12, such as a fusing belt, as a fusing element (example NexGlosser) in contact with a fusing roller 14 which makes a nip with a pressure roller 16. The belt fusing element 12 that is shown has an advantage since it allows the separation of the heat transfer and media release functions but other types could be used. The movable fuser element 12 is entrained around the internally heated fuser roller 14, a release roller 18 (NEW3), and a tension steering roller 20 (NEW 4) as shown in FIG. 1 so that the receiver R will pass through a nip 22. The heat transfer is accomplished mainly in the nip 22 formed by the internally heated metal fuser roller 14 and a backup pressure roller 16 which is covered with a thick layer 15 of elastomeric material to provide a large and variable nip 22. The image is fixed under a heated pressurized nip just like an internally heated roller fuser but the paper release is achieved by bending the belt against a smaller release roller 18 that creates an excellent release geometry defined by an angle ($\alpha$) relative to the paper feed as measured from a line through the center of the heated fuser roller 14 and the pressure roller 16 and the belt 12 as shown in FIG. 1. This angle is dependent on the specifics of the printer and paper as well as the toner composition as well as the desired output, such as degree of gloss.

FIG. 1 shows the fuser release system 10 including a fuser release sensor 23, which inputs to a logic and control system 24, also referred to as a Logic Control Unit (LCU), that controls the various aspects of the fuser release system 10, such as a heat sensor that can control heating of the fuser roller heater 16 or another sensor to help adjust the position of the release roller and also the steering roller, also referred to as a tension roller, 20. The fuser release system 10 can take on a number of positions that will be discussed below. The fuser roller 14 and the pressure roller 16 form the nip 22. A receiving sheet, also referred to as a receiver, R is considered to have entered the fuser release system 10 when it has entered the nip 22. The heater may be electrothermal, radiative, convective, or other heat sources suitable for fusing images, internal or external to the fuser roller, the particular type of heat source not being critical in the practice of the invention.

Figure 2:
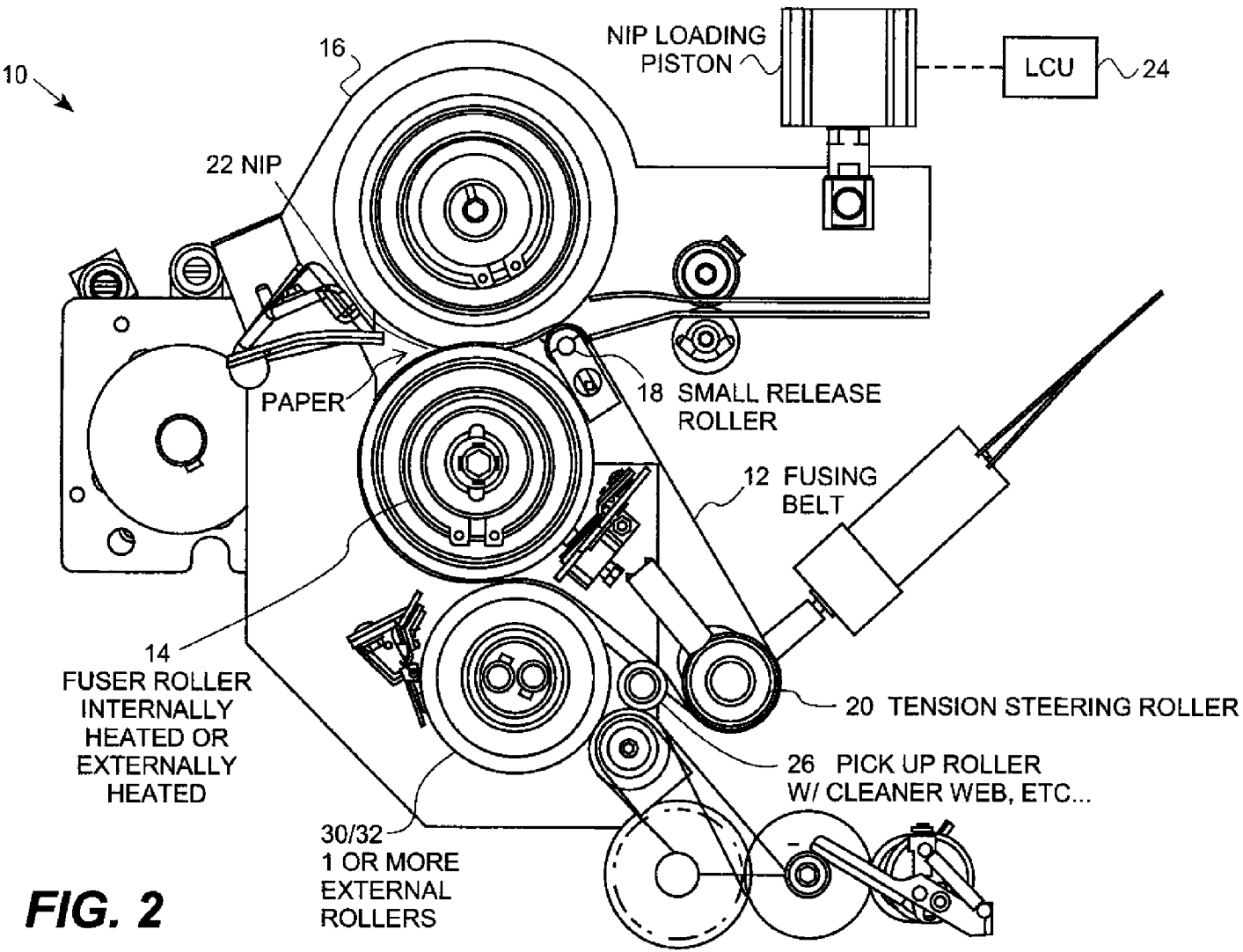
FIG. 2 is a schematic diagram of the fuser assembly according to this invention.

FIG. 2 shows one embodiment of the fusing system 10. This invention employs a fusing element, shown here as a fusing belt 12 (example NexGlosser). The belt fusing element has an advantage since it allows the separation of the heat transfer and media release functions. The fusing belt 12 is entrained around the internally heated fuser roller 14, release roller 18 and a steering roller 20 as shown in FIG. 1.

Figure 5:
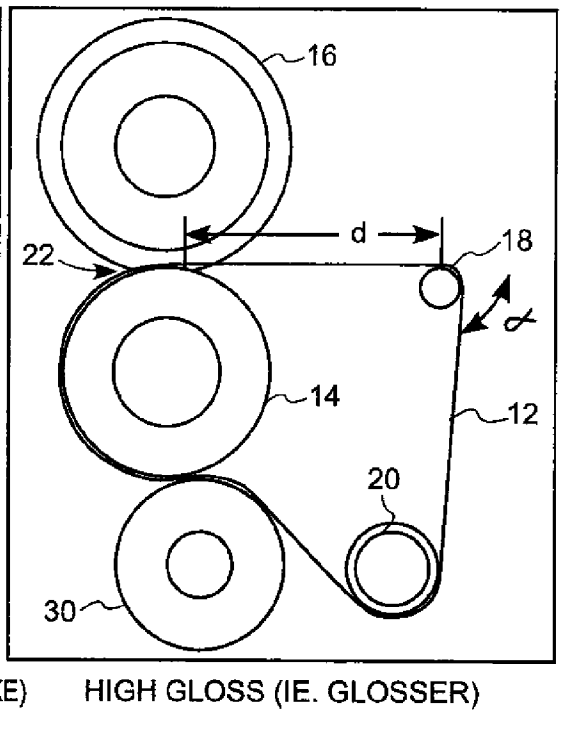
FIG. 5 is a schematic diagram showing another embodiment of the system.
Figure 4:
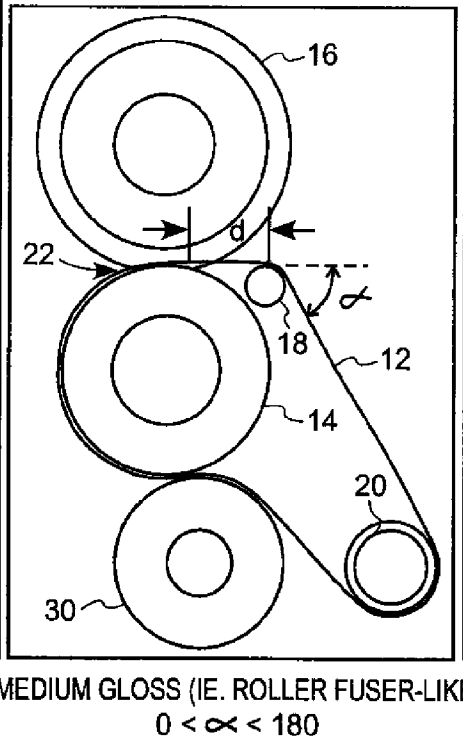
FIG. 4 is a schematic diagram showing another embodiment of the system.
Figure 3:
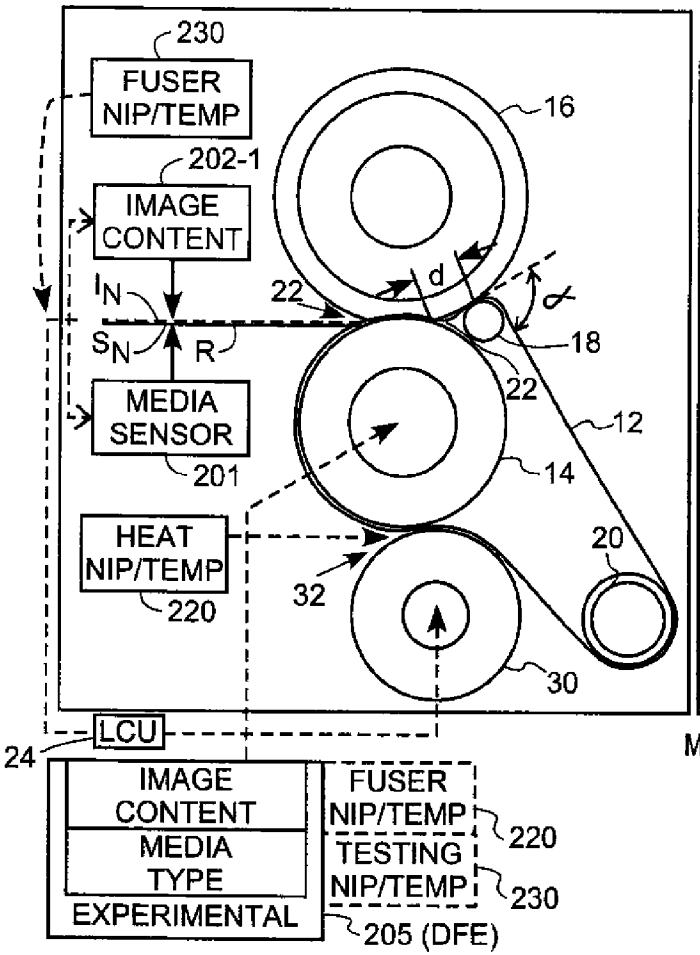
FIG. 3 is a schematic diagram showing one embodiment of the fusing system.

FIG. 3 shows one embodiment of the fuser system. In FIG. 3 the heat transfer is accomplished mainly in the nip 22 formed by a heated metal fuser roller 14 and a backup pressure roller 16 forming the nip 22. The image is fixed under a heated pressurized nip just like an internally heated roller fuser but the paper release is achieved by bending the belt against a smaller release roller 18 that creates an excellent release geometry defined by an angle ($\alpha$). In FIG. 3 the angle ($\alpha$) is between 0 and 180 degrees and the release roller 18 is in contact with the back-up roller 16. The angle ($\alpha$) is defined as the angle between a tangent created by extending the paper path line toward the release roller 18 and the line between the release roller and the steering roller 20 as shown in FIG. 3 and FIGS. 4 and 5 below. If the media types that usually experience a common problem, such as curl, are recorded in memory then the angle ($\alpha$) that can control this curl can be also added to a table and coupled with the media type to allow the fuser to automatically adjust angle ($\alpha$) for different receiver types.

The release geometry allows the media to separate due to its own stiffness from the fusing belt surface 12. The release roller 18 also provides an extended lower pressure contact after the media exits the main fuser nip. In one embodiment the internally heated fuser roller 14 is of conductive metal (aluminum, steel etc.) without any elastomer covering. The fuser roller can be heated to quite high temperatures without the fear of delaminating/degradation of such elastomeric layer. Further heat can be provided to the fusing belt by external means such as radiant heating lamps or one or more metal heating rollers 30 as is shown in the FIG. 3. The advantage of one or more external heating rollers 30 is that it provides a large low pressure contact area that does not harm the top release layer of the fusing belt. The external heating members are, in one embodiment, movable rollers so that the contact is variable to provide variable heat transfer.

The fuser release system offers many advantages that make high quality printing at speeds higher than 200 PPM as well as an excellent media release for a wide range of receiver media without the aid of mechanical or air skives and this can be obtained at a lower cost and higher life of fusing belt as compared to the fusing rollers. It can also be internally heated with a lamp and can have a diameter between 50-150 mm. The release roller 18 in another embodiment has a roller diameter between 15 to 80 mm and is moveable.

The fusing belt 12 shown has a base made of a metal, such as steel, aluminum, nickel, copper or similar heat conductive metals or even heat resistant plastics, such as polyimide or alike. It can be seamless or welded. It also has an intermediate coating that is a conductive elastomer 0.1 to 1.0 mm thick. Finally it has a topcoat made of low surface energy polymer such as pfa, pfe, ptfe, flc etc. that is 10 to 50 um thick. Also shown along with the steering roller 20 is a cleaning web and roller assembly 26 (See FIG. 2). The externally heated roller 30 can also be used an annealing roller if it is moved to be in contact with roller 14 and/or the fusing belt. Such an annealing roller would be made from polished aluminum or steel and internally heated. In one embodiment it would have a diameter of 20 to 50 mm. The system must be able to move so that it can engage or disengage with out a belt present. The method of annealing would include selectively moving heating roller (30) into contact with the roller 14 and increasing the temperature to an annealing temperature to refurbish the fuser in one embodiment.

Note that the external heating function can also be accomplished by other means such as radiant lamp etc. Finally the backup roller 16 can be made from an aluminum core that is 50-150 mm in diameter. One preferred embodiment uses back-up roller that is 100 mm diameter. The roller has soft and thick elastomeric coating to provide large nip. The coating thickness can be 1-15 mm. One preferred embodiment uses a 10 mm thick soft elastomer.

The belt fuser 12 allows the separating of the heat transfer and release functions of the fuser such that fuser roller could be made of hard metal core that can be heated to high temperatures without the fear of delaminating elastomeric coatings which are common in roller fusing. The release is achieved by bending the fuser belt around a smaller release roller 18 after the fuser nip between rollers 14 and 16. Media stiffness will make the media to separate from the belt at a sharp bend at roller 18. Furthermore additional heat can be provided by an external heat source such as heated roller 28. This advantage is important in high speed printing systems because of the need for high fusing temperatures. It is also useful when large quantities of toner are laid down to give special effects such as in raised print or extra gloss coverings.

Each controller may include a cam and a stepper motor for a fixed displacement nip, a pneumatic controlled tension device, a set of air regulated cylinders for constant load nip, a combination of both, or any combination of these and other electro-mechanical mechanisms well-known in the art. Since the tension of the steering roller as well as other things, such as a temperature of the fusing roller (as driven by the heating rollers nip) and the nipwidth between the fusing and pressure members can be manipulated and adjusted for each sheet, such a fusing assembly system allows mixing of many different media weights and types seamlessly without any restriction on the run length of each media. In distinct embodiments of the invention, the fusing member may be in the form of a roller, a belt or a sleeve, or variations thereof as are well known in the art. In a further embodiment of the invention a cleaning web 56 may be placed in contact with any of the rollers. The invention confers the advantage of enabling the printer to run jobs in document mode while mixing a variety of receivers, without loss of productivity or fusing quality. The invention also facilitates seamless printing on the widest possible ranges of media types and weights.

FIG. 4 shows another embodiment of the fuser system. The release roller is shown in a position away from the back-up roller 16 and this allows the fuser release system to control various receiver related concerns, such as paper curl, that can be induced in certain types of media and fusing nip shapes. The distance "d" represents a distance from the end of the nip 22 to the release roller where it makes contact with the fusing belt 12. This distance "d" can be controlled based on to handle a number of fuser related image quality characteristics. In addition the fuser release system allows an angle ($\alpha$) to be changed. Like FIG. 3, the embodiment shown in FIG. 4 can be used for a variety of media types, such as lighter media types, such as when curl is a problem.

FIG. 5 shows another embodiment of the fuser release system where the distance "d" is greater then shown in FIG. 4. When roller 18 is moved far from the nip and "d:" is increased, the system is able to provide a high gloss to the printed receiver. In this embodiment the system can impart a gloss surface. The control of the belt to gloss is described in commonly assigned applications U.S. Ser. No. 11/954,444, entitled: "ON DEMAND FUSER AND RELATED METHOD" and U.S. Ser. No. 12/323,495, entitled: EXTERNALLY HEATED FUSER DEVICE WITH EXTENDED NIP WIDTH which are both incorporated by reference herein. A media type and desired gloss can be input into a table of set points for various media types and the resulting location of the release roller 18 and the tension steering roller 20 necessary to achieve this desired result is automatically derived based on the table that used distance "d". This allows a dialable gloss level for all paper types, even those that are currently not able to be printed on with conventional printers. A data set can be used in conjunction with this embodiment, for example as a fourth data set, that includes a distance "d", that is retrieved from a set of stored set points for "d" in a table and that is matched with a matched temperature and media type that together produce a high gloss or variable gloss based on the contact time and temperature applied to the printed image. This date is stored in a table in the DFE, such as in a substrate catalogue, and is used as a gloss control based on substrate type and fuser temperature. These matched sets can be determined empirically or calculated.

Figure 6:
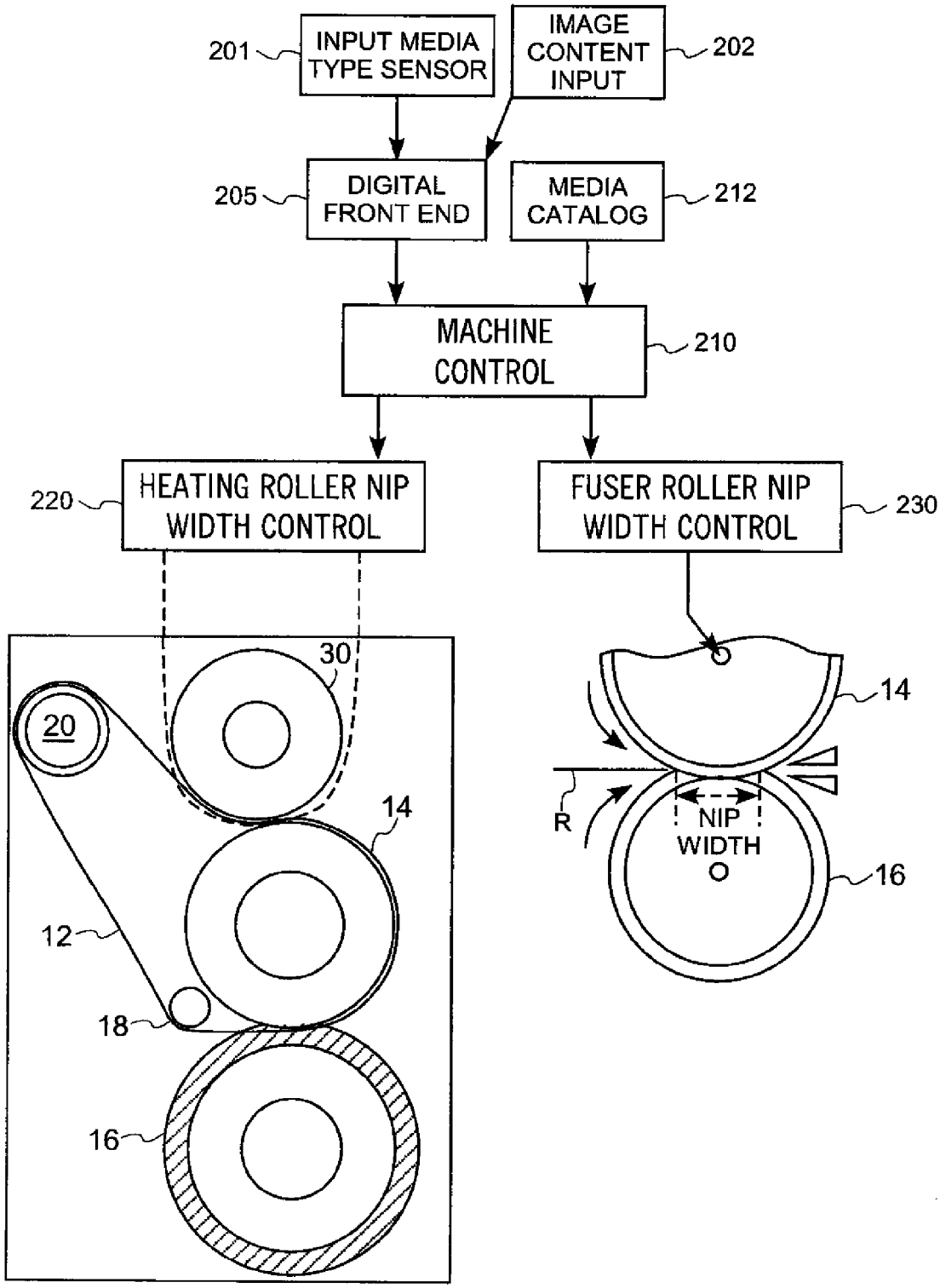
FIG. 6 is a schematic diagram showing another embodiment of the system.

In one embodiment as shown in FIG. 6, a sheet $S_n$ bears a toner image $I_n$. The toner content of the image and the type of media that receives the image are provided to the digital front end 205 (hereafter referred to as DFE) associated with the printer. The digital front end 205 and media catalog 212, including a table of angles or angle table discussed above, which provides the printer machine control 210 with signals representing respectively image content, and type of media and parameters of such media type being used. For quality control purposes, the apparatus has a media sensor 201 that senses the type and weight of the sheet $S_n$ and an image content sensor 202 senses the amount of toner that forms the image $I_n$. The heating roller controller 220, associated with the machine control 210, controls the nips 22 and 32 between heating rollers 16 and 30 to the fusing roller 14 respectively, as well as the temperature of each heating roller. The fuser roller nip width controller 230, associated with the machine control 210, controls the distance "d" and the angle ($\alpha$) by using the steering roller 20. The fuser assembly according to this invention adjusts the release roller 18 by changing the position of the rollers 18, 20 and thus the release angle ($\alpha$). The following embodiments show that the fuser release system described can enhance the glossing effects produced desiring printing and are controllable by adjusting the some or all of the following factors that contribute to fuser contact resistance, there by not only compensating for contact resistance but also using it to better control fusing. Contact resistance can change due to many factors that affect the surface of a receiver. These include the paper type, such as receivers having different surface finishes and thus different surface roughness. It also is related to the belt and the belt tension as well as the belt roller and fuser rollers and the surface including both internally and externally heated fuser rollers of the detack roller. The roller inside the belt is a critical and very important in how smooth the surface finishes is in minimizing the contact resistance. Also the pressure between the fusing rollers as well as the detack roller can affect the contact resistance as well in conjunction with the factors discussed above. It is even affected by the image itself. Some of the other factors influencing contact resistance can be found in "Thermal Analysis and Control of Electronic Equipment" (Kraus and Bar-Cohen 1983) that can be used to vary the fuser contact resistance include:

1. The number of contact spots
2. The shape of the contact spots; circular, elliptic, band, or rectangular
3. The size of the contact spots
4. The disposition or arrangement of the contact spots
5. The geometry of the contacting surfaces with regard to roughness and waviness
6. The average thickness of the void space (the noncontact region)
7. The fluid in the void space; gas, liquid, grease, vacuum
8. The pressure of the fluid in the void space
9. Thermal conductivities of the contacting solids and of the fluid in the void space
10. The hardness of the contacting asperities, that is will the asperities undergo elastic deformation?
11. The module of elasticity of the contacting asperitities undergo, that is will the asperities undergo elastic deformation?
12. The average temperature of the interface, that is will radiation be a factor?
13. The past history of the contact with regard to the number of previous compressions and decompressions
14. The contact pressure
15. The duration of the contact with regard to relaxation effects
16. Vibration effects
17. Directional effects
18. Contact cleanliness Kraus's book discusses how the thermal contact resistance is the heat transfer across two interfaces which are formed when the two bodies are brought in contact. Thermal contact resistance has units of (m^2*K)/watt or the inverse of the thermal contact resistance is called thermal contact conductance which has units of watt/(m^2*K). One way of describing the thermal contact conductance coefficient can be denoted as "hc". According to Fourier's Law, as the equation written below:

$$q = -k \cdot A_c \cdot \frac{dT}{dx}$$

This equation represents the heat flow (q) across the cross sectional area (Ac), the thermal conductivity (k) of the body material and a temperature gradient (dT/dx) in the direction of flow.

Figure 7:
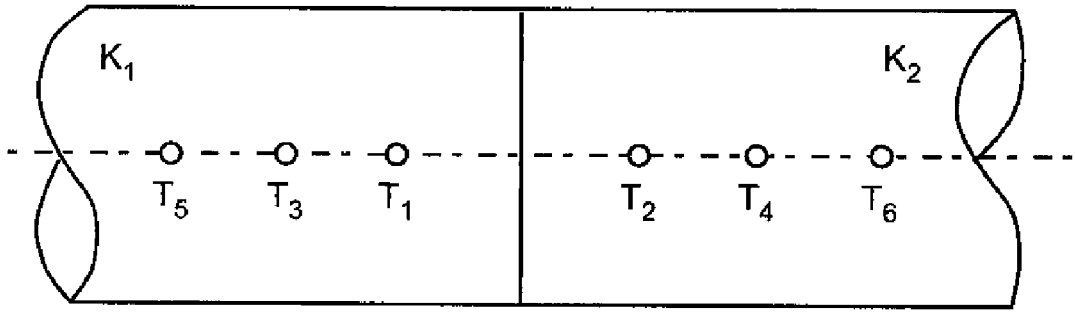
FIG. 7 illustrates two solid metal bars in contact. Temperature designations for simulated problem. Linear temperature profile for this real interface condition.
Figure 7:
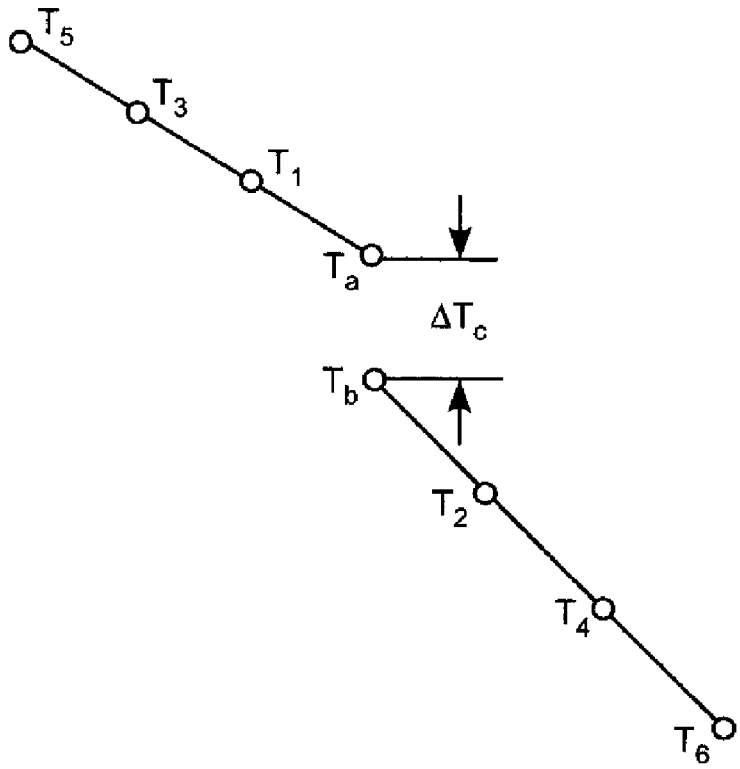

FIG. 7 illustrates one situation discussed by Krauss that is the thermal contact conductance by two bars coming in contact. Heat is flow from left to right as shown by the temperature gradient decreasing in this direction. What is observed from the thermal contact conductance or contact resistance is a temperature drop across the mating interface of the two solid bars with two different thermal conductivities.

$$\text{Thermal Contact Resistance is } \frac{1}{h_c}$$

Therefore applying Fourier Law's, a one dimensional model to represent heat flow is written below with thermal contact conductance with denoting Aa is the apparent contact area and he is contact coefficient or contact conductance. A new equation to describe the contact area is as follows:

$$A_a = A_c + A_v$$

Aa is the apparent contact between the two bars of material. Ac is the physical area where there exist many contacts between the two bodies of material and Av is the non-contacts or voids that do not touch. Between the surfaces of the two bodies making contact contain surface irregularities where the height is called $$\frac{\delta_v}{2}.$$

Figure 8:
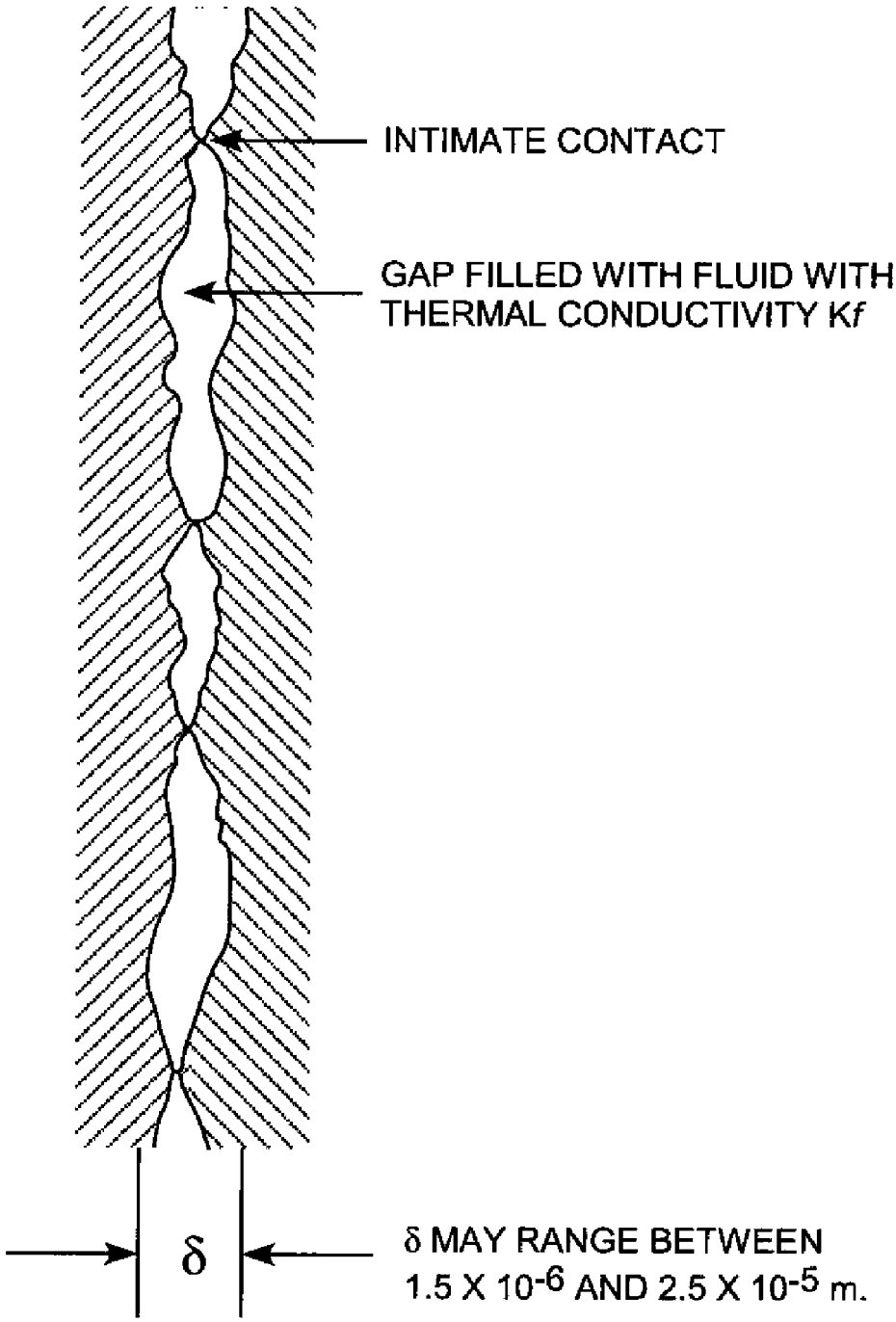
FIG. 8 is a schematic drawing of a real interface between two solids.

Kraus goes on to describe the following heat flow equation to describe the thermal contact resistance of the situation, as shown in FIG. 8, in the following form:

If metal 1 and metal 2 each have surface irregularities of height δv/2, then the heat flow across the interface is composed of two paths $$q = \frac{T_a - T_b}{\delta_v/(2k_1A_c) + \delta_v/(2k_2A_c)} + \frac{k_f A_v (T_a - T_b)}{\delta_v} = h_c A_a (T_a - T_b)$$

and an evaluation of $h_c$ then follows:

$$h_c = \frac{1}{\delta v} \cdot \left[ 2 \cdot \frac{Ac}{Aa} \cdot \frac{k1 \cdot k2}{(k1 + k2)} + \frac{Av}{Aa} \cdot k_f \right] \tag{9.3}$$

The use of Eq. (9.3) is dangerous. If one assumes that air, or a similar fluid, fills the void space and that $k_f << k_1$, $k_f << k_2$, there is a tendency to neglect the second term within the brackets in Eq. (9.3).

For example, for two polished steel surfaces in contact with k1=k2=20 W/(m° C.) and Ac/Aa=0.005. Then from Eq. (9.2), $$A_v = A_a - A_c = 1.000 - 0.005 = 0.995$$

and Av/Aa=0.995. Here $$2\frac{A_c}{A_a}\frac{k_1k_2}{k_1 + k_2} = 2(0.005)\frac{(20)^2}{2(20)} = 0.100$$

and with $k_f$=0.030 W/m° C., $$\frac{A_v}{A_a}kf = 0.995(0.030) = 0.030$$

It is important to note that he coefficient as described by the materials used in the belt fusing process will be driven to affect the surface finish factors, pressures and thermal gradients between each body contact(s) where the melting of the dry ink for the different paper media will allow us to design to a desired gloss level. These relationships can be formed to derive and describe the electro photographic materials making contact that can allow us to affect gloss level on the receiver. In one example the following values describe a fuser system's contact resistance.

$$\text{Contact Resistance} = 0.005_m \frac{2K}{W}$$

$$\text{Conductance} = \frac{1}{\text{Contact Resistance}} = 2\times10^{-3}\ \frac{W}{mm2_k}$$

The following table shows results from one model having a low pressure nip and the "effective conductance" was varied between 0.001 (worse case) to 0.002 W/mm^2K and no support, only tension from belt under load. The calculation used an average ambient temperature of 23° C. @ HTC of 5 watt/m^2K, radiational cooling included which assumes PFA is ~100% Translucent with BC emissivity ~0.9 and a fixed 90° C. core wall temperature in the fuser. This used an average ambient temperature of 40 C @ HTC of 5 watt/m^2K, radiational cooling included which assumes Polyimide is ~400% Translucent with BC emissivity ~0.9 but for 0.12 for the stainless steel. The fusing roller OD was 88.9 mm, the pressure roller OD was 108.9 mm and the heater roller OD was 73.025 mm resulting in a belt tension of about 25 lbf. Also the high pressure nip length is 19 mm, the low pressure nip length is 21.3 mm, the belt nip has a total length=40.3 mm and the page width is 360 mm for the power calculations. A broader range of contact resistances may range from 0.0001 or 0.0001.5 to 0.0013 (m^2K)/W for the effective contact resistance between the belt, media and toner.

A Polyimide belt can work as a heating member with or without a roller for an 81° C. paper to dry ink interface temperature but for 100° C. target for the 300 gsm profigloss with 320% area coverage then a heating roller will be required. This assumes the conductance in the low pressure nip zone is 0.002 W/mm^2K. Thus the stainless steel belt targeting a 100° C. for the receiver to dry ink interface temperature can work where the Fuser Roller Core Temp would operate at 272° C. with 0.002 W/mm^2K conductance in the low pressure nip with no heater roller assistance. If the conductance in the low pressure (LP) Nip zone is 0.001 W/mm^2K then polyimide belt case will not be achieved even with a heating roller but the stainless steel belt case would just hit 98° C. with both the heating roller (HR) and fusing roller (FR) cores at full tilt at 300° C. Also, the contact for the heating roller could be improved. Thus in general, using a stainless steel belt for the same thickness will significantly drop the core temperature over a polyimide material but the power consumption difference between the two material choices may consume 140 to 200 watts more depending on the low pressure nip conductance (0.001 and 0.002 respectively). There are additional heat losses from end of the rollers beyond those within the page width. The results are shown below for a target temperature of 81 degrees C.

| Paper to Dry Ink Temperature Target = 81 C. | | | | | | |
|---|---|---|---|---|---|---|
| | | For LP Nip Conductance = 0.002 | | | Core Temperatures C. | |
| | | Archi-tecture | Fusing Power | Fusing Efficiency | case 1 FR/HR | case 2 FR/HR |
| units (W) | Poly | 4137 | 3165 | 76.6% | 217.8/OFF | 172.5/300 |
| | SS302 | 3985 | 3169 | 79.8% | 196/OFF | 165.9/300 |
| | Power Savings | 153 | same | 3.1% | −21.8 | −6.6 |

by using SS302 belt

| | | For LP Nip Conductance = 0.001 | | | Core Temperatures C. | |
|---|---|---|---|---|---|---|
| | | Archi-tecture | Fusing Power | Fusing Efficiency | case 1 FR/HR | case 2 FR/HR |
| units (W) | Poly | 4440 | 3217 | 72.6% | 255.2/OFF | 216.3/300 |
| | SS302 | 4213 | 3217 | 76.6% | 230.8/OFF | 206.7/300 |
| | Power Savings | 228 | same | 4.0% | −24.4 | −9.6 |

by using SS302 belt

Lower Conductance Consumes More Power

| | | |
|---|---|---|
| Poly Belt-Conductance 0.001 vs 0.002 | 303 | Watts |
| SS302 Belt-Conductance 0.001 vs. 0.002 | 228 | Watts |
| Based on Belt Material Difference | 75 | Polymide consumes this difference |

The results are shown below for a target temperature of 100 degrees C.

| Paper to Dry Ink Temperature Target = 100 C. | | | | | | |
|---|---|---|---|---|---|---|
| | | For LP Nip Conductance = 0.002 | | | Core Temperatures C. | |
| | | Archi-tecture | Fusing Power | Fusing Efficiency | case 1 FR/HR | case 2 FR/HR |
| units (W) | Poly | 5509 | 4016 | 73.0% | 300/OFF | 276.5/300 |
| | SS302 | 5227 | 4042 | 77.4% | 271.5/OFF | 252.8/300 |
| | Power Savings | 282 | same | 4.5% | −28.5 | −23.7 |

by using SS302 belt

Paper to Dry Ink 81 C vs. 100 C Target-Power Consumption Difference

| | | |
|---|---|---|
| For Polyimide Belt | 1372 | Increase power to fuse @ 100 C. |
| For SS302 Belt | 1242 | Increase power to fuse @ 100 C. |
| Material Difference | 130 | (W) savings by going with stainless steel 302 |

The current invention thus can result in a desirable low delta temperature from the fuser to the receiver by using the following results that yields an averaged contact resistance and delta temperatures as low as 4-5 degrees for uncoated paper.

| | Conductance | | | | | |
|---|---|---|---|---|---|---|
| | 0.001 dT | | | 0.002 dT | | |
| | End of Nip | End of Detack | | End of Nip | End of Detack | |
| Toner Surface | 90.2 | 85.2 | −5 | 79.1 | 86.1 | 7 |
| Toner to Paper Interface | 69.7 | 81.1 | 11.4 | 78.6 | 81.03 | 2.4 |
| | 20.5 | 4.1 | | 0.5 | 5.07 | |

In another embodiment, turning the fuser heater on and off will enhance these results because turning heating roller on and off causes power differences for the same target paper to toner temperature interface which will affect the allowable temperature limit for the proposed material properties to be used in application. Therefore, heating roller will have no affect on the gloss level between the end of the high pressure nip and detack roller.

The fuser assembly according to this invention also applies print engine intelligence as referred to above. The fuser process set points (fuser nip width, fuser member temperature, and energy requirements) for various types of media are stored as lookup tables in a media catalog 212 for the machine control unit 210 (see FIG. 4) and these are used to control the fuser as well as the release apparatus and system. The media can include heavy stock cover material, interior page print material, insert material, transparency material, or any other desired media to carry text or image information. A typical machine control unit 210 includes a microprocessor and memory or microcomputer. It stores and operates a program that controls operation of the machine in accordance with programmed steps and machine inputs, such as temperature of the fusing rollers. Temperature data is supplied, for example, by a thermocouple (not shown) or any other suitable thermal sensor in a manner well known to those skilled in the art. As a sheet of a specific media type is requested, the DFE 205 provides a data signal to the machine control unit 210 (or alternatively, directly to an independent control for the fuser assembly) that is representative of the image contents and the type of media sheet coming to be fixed. The machine control unit 210 sets the fuser conditions (temperature; dwell time) from the media catalog 212 as a function of the data provided by the DFE 205. Machine control unit 210 directs the heating roller nip width control 220 for heating rollers to adjust the nip width according to the power requirements for heating the fuser belt per the information provided from media catalog 212. Machine control unit 210 also directs the fuser roller nip width controller 230 for fusing roller 14 and pressure roller 16 to adjust the fuser nip per the information provided from media catalog 212.

The invention has been described in detail with particular reference to certain preferred embodiment thereof, but it will be understood that variations and modifications can be effected within the spirit and scope of the invention.

What is claimed is:

1. An electrostatographic printer for maintaining print quality, said apparatus comprising:

a. a heated fusing member, including a power supply for controlling temperature of the fuser based on a receiver-fuser contact resistance, for fusing toner to sheets of receiver media;

b. a pressure member in contact with the heated fusing member to form a fusing nip there between;

c. a release system adjacent the pressure member at a distance "d" having a release angle $\alpha$;

d. a machine controller for changing the release angle $\alpha$ in accordance with the receiver-fuser contact resistance and the image on the media;

e. a heating member controller associated with the machine controller, for changing temperature of the heated fusing member; and f. a release system controller associated with the machine controller, for changing the position of the release system relative to the pressure member and the heated fusing member.

2. The apparatus of claim 1, the release system further comprising a release roller adjacent a fusing belt wherein the receiver-fuser contact resistance is a belt contact resistance.

3. The apparatus of claim 2, the release system controller further comprising a tension steering roller that varies the belt contact resistance.

4. The apparatus of claim 1, wherein the receiver-fuser contact resistance is a receiver media contact resistance.

5. The apparatus of claim 4, the machine controller further changing the distance "d" in accordance with the receiver media contact resistance, the image on the media and the gloss requirements.

6. The apparatus of claim 1, the receiver-fuser contact resistance is between 0.0001 and 0.0013 ((m^2)K)/W where m is in meters, K is temperature in Kelvin and W is the amount of energy applied during fusing in Watts.

7. The apparatus of claim 1, further comprising turning the heater fusing member on and off while printing the receiver media to further control temperature in accordance to the receiver-fuser contact resistance.

8. The apparatus of claim 1, the heater fusing member further comprising one or more external heating members.

9. The apparatus of claim 8, wherein the one or more external heating members are movable rollers to vary a heated fusing member to receiver heat transfer in relation to the receiver-fuser contact resistance.

10. The apparatus of claim 1, further comprising a processing system device for calculating a minimum receiver-fuser temperature difference based on the receiver-fuser contact resistance, current process measurements and thermal load related set-points, or a derivative thereof, indicative of print quality for a particular media that includes a comparator wherein a first information, or a derivative thereof, is compared to a calculated quality adjustment range in a table, or a derivative thereof, indicative of print quality and a release system adjuster to adjust the current conditions so they trend towards a new thermal load set point within the quality adjustment range in a controlled manner based on the comparison.

11. The apparatus of claim 1, further comprising a processing system device for calculating a set gloss level range based on the receiver-fuser contact resistance, current process measurements and thermal load related set-points, or a derivative thereof, indicative of a set of gloss level for a particular media that includes a comparator wherein a first information, or a derivative thereof, is compared to the calculated gloss level range in a table, or a derivative thereof, indicative of the gloss level and a release system adjuster to adjust the current conditions so they trend towards a new thermal load set point within the gloss level range in a controlled manner based on the comparison.

12. A method of forming a variable gloss on receiver by fusing toner to sheets of receiver media in an electrostatographic printer, for each dedicated run of the specified receiver, comprising:

a. providing a first data set, including set points representative of one or more receiver-fuser contact resistances;

b. providing a second data set representative of a particular type of arriving receiver media in the current set-up, as a current receiver-fuser contact resistance;

c. providing a third data set representative of the set-points related to a current set-up in a desired set gloss level;

d. selectively adjusting a release system adjacent the pressure member at a release angle $\alpha$ from a line through the nip using a controller for changing release angle $\alpha$ in accordance with set points for a receiver-fuser contact resistance of the type of arriving receiver media and the set gloss level.

13. The method of claim 12, further comprising a fourth data set including a new distance "d", stored in the media catalogue, as a variable gloss control based on the arriving receiving media and fuser temperature.

14. The method of claim 13, wherein a run comprising printing a 50-250 set of receiver sheets, to reach a steady-state situation, is done before taking measurements on the release angle and storing these measurements in the media catalog.

15. The method of claim 12, further comprising selectively moving a heating roller into and out of contact with the heated fuser member as a variable gloss control.

16. The method of claim 12, wherein the selectively adjusting is made at a controlled rate of change and the controlled rate of change is optimized based on a set of rules that are chosen based on current process conditions.

17. The method of claim 12, wherein the temperature control tends toward a minimum receiver-fuser temperature difference based on the on a receiver media type, a heated fusing member temperature, the receiver-fuser contact resistance, current process measurements and thermal load related set-points, or a derivative thereof, indicative of print quality for a particular media that includes a comparator wherein a first information, or a derivative thereof, is compared to a calculated quality adjustment range in a table, or a derivative thereof, indicative of print quality and a release system adjuster to adjust the current conditions so they trend towards a new thermal load set point within the quality adjustment range in a controlled manner based on the comparison.

18. The method of claim 12, wherein the receiver-fuser contact resistance is kept between 0.0001 and 0.0013 ((m^2) K)/W where m is in meters, K is temperature in Kelvin and W is the amount of energy applied during fusing in Watts.

19. The method of claim 12, the selectively adjusting further comprising controlling a release roller adjacent a fusing belt using a tension steering roller.

20. The method of claim 19, wherein the release angle and distance "d" are varied according to stored data including receiver media type, receiver-fuser contact resistance release roller characteristics, operating conditions and gloss requirements.

* * * * *